US010494065B1

(12) United States Patent
Cifers et al.

(10) Patent No.: US 10,494,065 B1
(45) Date of Patent: Dec. 3, 2019

(54) SEAT RETENTION MECHANISM

(71) Applicant: Luther Cifers, Amelia, VA (US)

(72) Inventors: Luther Cifers, Amelia, VA (US); Matthew Montaruli, Greenville, SC (US); Hans Nutz, Easley, SC (US)

(73) Assignee: Bonafide, Burkeville, VA (US)

( * ) Notice: Subject to any disclaimer, the term of this patent is extended or adjusted under 35 U.S.C. 154(b) by 0 days.

(21) Appl. No.: 16/030,656

(22) Filed: Jul. 9, 2018

Related U.S. Application Data

(60) Provisional application No. 62/530,273, filed on Jul. 9, 2017, provisional application No. 62/530,283, filed on Jul. 9, 2017.

(51) Int. Cl.
*B63B 35/71* (2006.01)
*B63B 29/04* (2006.01)

(52) U.S. Cl.
CPC ..... *B63B 35/71* (2013.01); *B63B 2029/043* (2013.01); *B63B 2035/715* (2013.01)

(58) Field of Classification Search
USPC ..... 248/429
See application file for complete search history.

(56) References Cited

U.S. PATENT DOCUMENTS 3,282,229 A * 11/1966 Elsner ..... B60P 7/0815 410/105
4,109,891 A * 8/1978 Grendahl ..... B60P 7/0815 248/503.1
4,114,947 A * 9/1978 Nelson ..... B60N 2/01558 248/503.1
5,169,091 A * 12/1992 Beroth ..... B64D 9/003 244/118.1
5,178,346 A * 1/1993 Beroth ..... B64D 9/003 244/118.1
5,383,630 A * 1/1995 Flatten ..... B64D 11/06 244/118.6
5,921,629 A * 7/1999 Koch ..... B64D 11/06 244/118.6
6,270,137 B1 * 8/2001 Minix ..... B60P 3/32 248/503
7,785,053 B2 * 8/2010 Hudson ..... B64D 11/0696 410/104
8,066,248 B2 * 11/2011 Christensen ..... B64D 11/0696 248/429
8,292,224 B1 * 10/2012 Ahad ..... B61D 33/0057 244/118.6
8,376,306 B2 * 2/2013 Dowty ..... B61D 33/0057 248/429
8,528,860 B2 * 9/2013 VanderWolk ..... B64D 11/0696 244/118.5

(Continued)

*Primary Examiner* — Monica E Millner
(74) *Attorney, Agent, or Firm* — Thedford I. Hitaffer; Hitaffer & Hitaffer, PLLC

(57) ABSTRACT

A retention mechanism is provided for mounting the seat to a watercraft. The retention mechanism may comprise a receiver for receiving a graspable member of the seat therein. The receiver is upwardly open to receive the graspable member. A slide moves horizontally to partially obstruct the receiver so that the graspable member cannot escape from the receiver. A manual lever moves the slide between a locked for constraining the graspable member and an unlocked position for allowing the graspable member to be received by and removed from the receiver.

14 Claims, 10 Drawing Sheets

(56) References Cited

U.S. PATENT DOCUMENTS

| | | | | |
|---|---|---|---|---|
| 8,870,119 | B2 * | 10/2014 | Baatz | B64C 1/20 244/118.6 |
| 9,671,060 | B1 * | 6/2017 | Cifers | F16M 13/02 |
| 9,902,498 | B2 * | 2/2018 | Gensch | B60N 2/01575 |
| 10,005,558 | B2 * | 6/2018 | Cailleteau | A47B 91/08 |
| 2007/0194191 | A1 * | 8/2007 | Persson | F16M 13/02 248/225.11 |
| 2009/0038526 | A1 * | 2/2009 | Walton | B63B 29/04 114/347 |
| 2012/0045276 | A1 * | 2/2012 | Carnevali | F16B 7/20 403/350 |
| 2014/0003878 | A1 * | 1/2014 | Knox | B60P 7/0807 410/104 |

* cited by examiner

SEAT RETENTION MECHANISM

CROSS-REFERENCE TO RELATED APPLICATIONS

This application claims the benefit of U.S. Provisional Application No. 62/530,273, filed on Jul. 9, 2017, and U.S. Provisional Application No. 62/530,283, filed Jul. 9, 2017, the disclosures of which is incorporated herein by reference by their entirety.

BACKGROUND OF THE INVENTION

This invention relates in general to watercraft, and more particularly, to seating for watercraft. Most particularly, the invention relates to low-high adjustable seats and seat supports for watercraft, particularly for use with kayaks.

Various seating arrangements are known to be used on kayaks and other small watercraft. It is desirable that the seat be comfortable. To achieve comfort over time, or for users who vary in size, adjustment in seat height may be desirable, particularly, while in open waters, and while the watercraft is in use. It is also desirable that the seat be both well secure, while at the same time, detachable for transporting and storing the seat separate from watercraft.

A seat retention mechanism is also needed for securely attaching a seat to a watercraft in a manner that permits the seat to be readily removed without the aid of tools, while permitting adjustments in the seat to be readily made, on the fly, without encountering difficulties or cumbersome components or adjustment features.

SUMMARY OF THE INVENTION

This invention relates to a retention mechanism for securely attaching a seat to a watercraft in a manner that permits the seat to be readily removed without the aid of tools. The seat retention mechanism comprises a first member that is configured to be mounted to a supporting surface of the watercraft. The first member comprises an attachment element and at least one receiver. The attachment element enables the first member to be attached to the supporting surface. The receiver is configured to receive the graspable member of the seat to constrain the seat against longitudinal motion relative to the supporting surface. A slide is slidably movable along the first member between a locked position and an unlocked position. The slide includes an obstructive member for the receiver. The obstructive member is configured to obstruct the receiver and prevent the graspable member of the seat from escaping from the first member when the slide is moved to the locked position. A manual actuator is operable to move the slide between the locked position and the unlocked position.

Various advantages of this invention will become apparent to those skilled in the art from the following detailed description of the preferred embodiment, when read in light of the accompanying drawings.

BRIEF DESCRIPTION OF THE DRAWINGS

Various features and attendant advantages of the seat will become more fully appreciated when considered in view of the accompanying drawings, in which like reference characters designate the same or similar parts and/or features throughout the several views, and wherein.

DETAILED DESCRIPTION OF THE PREFERRED EMBODIMENT

It should be noted that orientational terms used throughout this description are with reference to the orientation of the seat and component parts thereof as presented in the accompanying drawings, which is subject to change. Therefore, orientational terms are used for semantic purposes, and do not limit the invention or its component parts in any particular way.

Figure 2:
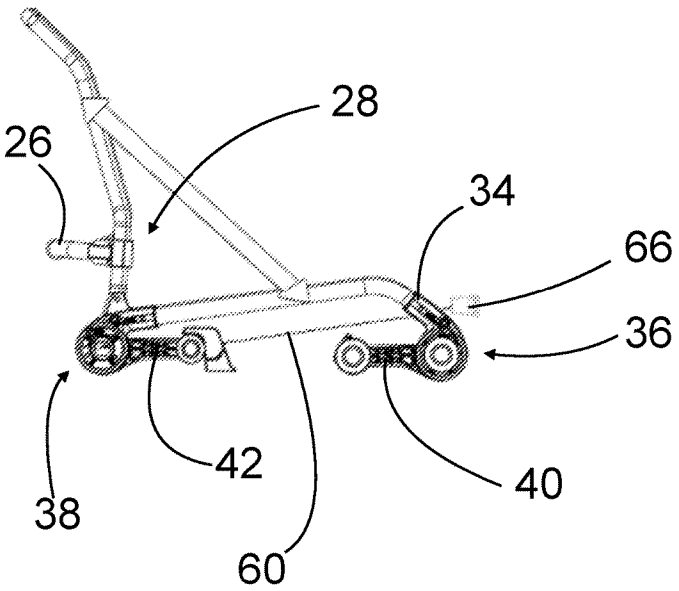
FIG. 2 is a side elevational view of the seat shown in FIG. 1.
Figure 1:
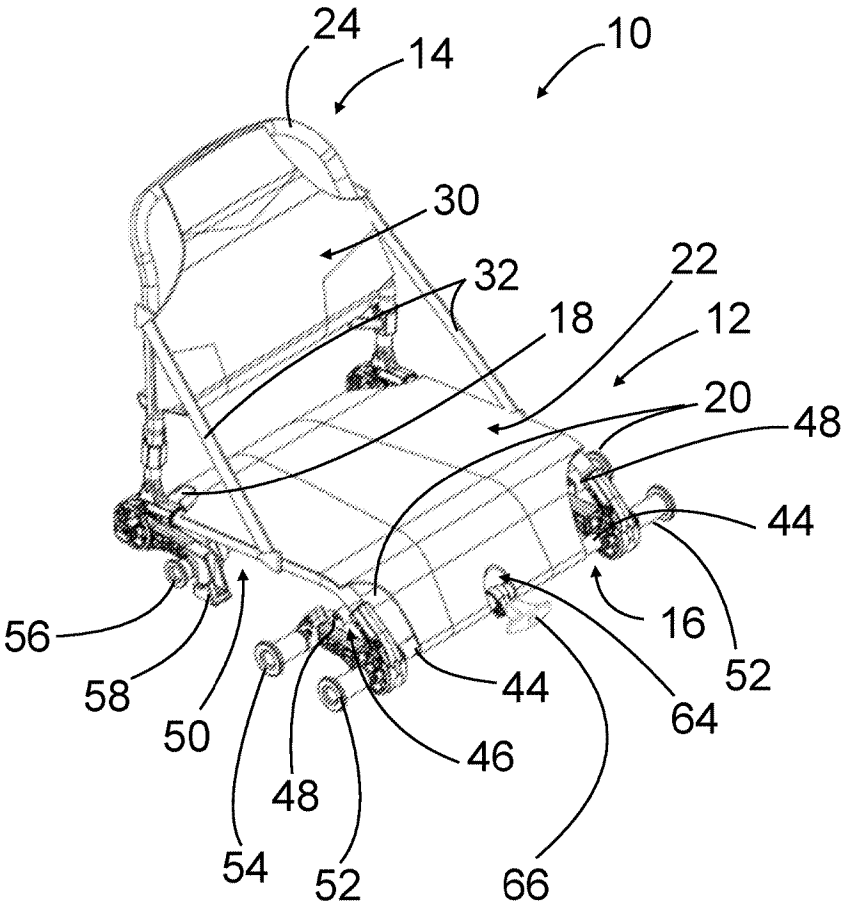
FIG. 1 is a front perspective view of an exemplary seat with a low-high adjustment, wherein the seat is in a fully lowered position.
Figure 3:
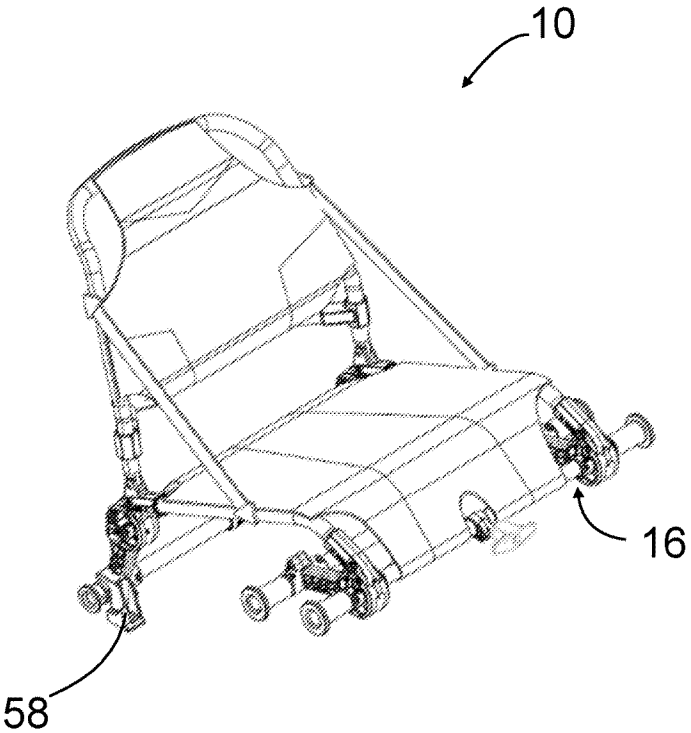
FIG. 3 is a front perspective view of the seat with a front end of the seat lifted and rear legs of the seat lowered to raise the rear end of the seat.

Referring now to the drawings, there is illustrated in FIGS. 1-3 a seat 10 for watercraft (not shown). The seat 10 comprises a seat base 12 and a seat back 14. The seat base 12 comprises longitudinally spaced front and rear seat base tubes or cross bars 16, 18 and laterally spaced seat base side tubes 20, joined together to form a rigid frame. The seat base 12 supports a seat base panel 22, which may be in the form of a canvas panel. The seat base panel 22 can be supported in relation to the seat base 12 in any suitable manner, such as with the use of seat base panel straps (not shown) that extend beneath the seat base panel 22 in longitudinal and lateral directions and are pulled tight so that the seat base panel 22 is sufficiently taut in longitudinal and lateral directions to support the weight of a user. Two or three seat base panel straps may extend in both the longitudinal and lateral direction. The seat back 14 comprises a seat back tube 24, which in the illustrated embodiment, is in the form of an inverted U-shaped tube. A seat back cross bar 26 extends laterally between legs of the U-shaped tube and has opposing ends connected to the legs of the U-shaped tube via seat back cross bar joints 28. The seat back cross bar joints 28 may each be comprised of a sleeve (shown but not referenced) through which the seat back tube 24 passes and a transverse tube socket (shown but not referenced) into which the seat back cross bar 26 is inserted. A seat back panel 30 is supported in relation to the seat back tube 24 and the seat back cross bar 26. The seat back panel 30 may be in the form of a canvas panel. The seat back panel 30 can be supported in relation to the seat back tube 24 and the seat back cross bar 26 in any suitable manner, such as with the use of seat back straps (not shown) that extend behind the seat back panel 30 in vertical and lateral directions and are pulled tight so that the seat back panel 30 is sufficiently taut to support the user's back. Two or three straps may extend in both the longitudinal and lateral directions. The seat back cross bar 26 bends the seat back panel 30 out to provide lumbar support for the user. Seat back adjustment straps 32 extend between the side tubes 20 and corresponding legs of the U-shaped tube that forms the seat back tube 24. The seat back adjustment straps 32 are adjustable to adjust the angle of the seat back 14 in relation to the seat base 12 as desired by the user.

The front and rear seat tube or cross bars 16, 18, side tubes 20, and where used, seat back tube 24 and seat back cross bar 26, collectively form a structural frame for maintaining the perimetric geometry of seat base panel 22. Either or both of seat base panel 22 and seat back panel 30 could be formed from materials sufficiently rigid and strong as not to require the structural frame, such as wood, plywood, metal, composites, or plastic plates and combinations of these materials. Where the seat base 22 and/or the seat back panel 30 are formed of rigid and strong materials, the seat base panel 22 and seat back panel 30 serve as the structural frame as well as performing body support functions for the body of the user of the watercraft.

Terminal ends (shown but not referenced) of the seat base side tubes 20 are received in tube sockets 34, which form a part of front and rear pivot or knuckle joints, generally indicated at 36, 38. It should be understood that knuckle joints 36, 38 are pivot joints enabling the front and rear legs 40, 42 to pivot about respective the front and rear cross bars 16, 18. As the front and rear legs 40, 42, which may pivot independently of one another, pivot, the seat base panel 22 will rise or lower relative to features 54, 56. This is because proximal ends of the front and rear legs 40, 42 are pivotally connected to the structural frame, while distal ends are anchored to the watercraft. Lower ends (shown but not referenced) of the seat back tube 24 are supported in relation to the rear knuckle joints 38, such as, for example, by seat back tube sockets (shown but not referenced) supported in relation to the rear knuckle joints 38.

The rear seat base cross bar 18 extends laterally. Opposing ends (shown but not referenced) of the front seat base cross bar 16 are supported in relation to the front knuckle joints 36. Opposing ends (shown but not referenced) of the rear seat base cross bar 18 are supported in relation to the rear knuckle joints 38.

Front legs 40 extend from the front knuckle joints 36 and rear legs 42 extend from the rear knuckle joints 38. Each of the legs 40, 42 pivots in relation to respective knuckle joints 36, 38 to adjust the height of the seat 10, as will become apparent in the description that follows. Opposing ends of a front leg cross bar 46 are supported in relation to lower ends of the front legs 40. Opposing ends of a rear leg cross bar 50 are supported in relation to lower ends of the rear legs 42. Front and rear features 52, 54, 56 extend laterally outward from the lower ends of the front legs 40, the front knuckle joints 36 and the lower ends of the rear legs 42, respectively. These features 52, 54, 56 cooperate with features, such as the hook 58 shown and a retention mechanism (described hereinafter, with reference to FIGS. 9-23), supported in fixed relation atop the watercraft along each side thereof.

In the illustrated embodiment, a pull cord 60 has a distal or terminal end attached to the rear leg cross bar 50, preferably to a central point thereof (i.e., centralized between lateral sides of the seat 10). The pull cord 60 extends from the rear leg cross bar 50 towards the front of the seat 10, where the pull cord 60 passes through a guide or eyelet supported in relation to the front seat base cross bar 16, preferably at a central point thereof (i.e., centralized between lateral sides of the seat 10). The guide may simply be in the form of a block having a through hole passing longitudinally therethrough left to right when viewing the drawings). An underside of the block may be provided with a saddle surface for mounting the block to the cylindrical surface of the front seat base cross bar 16. The seat base panel 22 may be provided with an opening 64 therein, adjacent the front seat base cross bar 16 and the guide supported thereby. A pull handle 66 is attached to a proximal end of the pull cord 60.

The pull cord 60 and its associated pull handle 66 are one form of adjustment linkage functional to pivot the rear legs 42 relative to hooks 58 to effect vertical adjustment of seat base panel 22. As will be appreciated from FIGS. 6 and 8, the adjustment linkage (e.g., the pull cord 60) is configured and located to be accessible to a user seated in the seat 10 or positioned just above the seat 10. The user need only reach below the seat 10 to grasp the adjustment linkage. This feature is particularly advantageous for kayaks, because kayaks are notoriously narrow. Extensive maneuvering of user body position to improve access to the adjustment linkage, as would be necessary if the adjustment linkage were not readily accessible, could easily cause the watercraft to tip or capsize.

Figure 4:
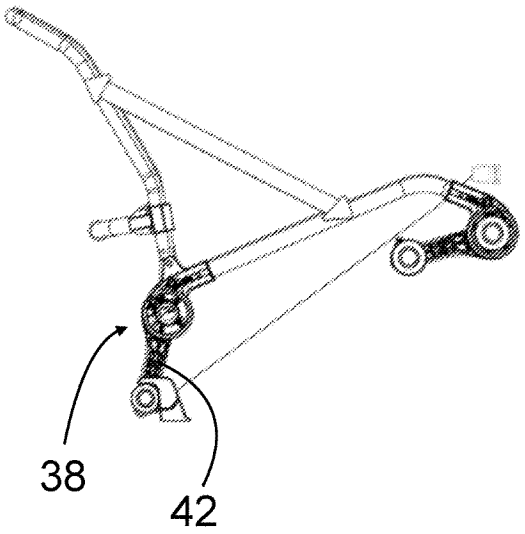
FIG. 4 is a side elevational view of the seat shown in FIG. 3.

In operation, the seat 10 is the lowered position, as shown in FIGS. 1-2. The rear laterally extending features 56 may be supported against forward movement in relation to hooks 58. To raise the rear legs 42, the user pulls forward on the front seat base cross bar 16 or the front leg cross bar 46 (i.e., to the right when viewing the drawings). In doing so, the rear legs 42, with the lower ends constrained from forward movement by the hooks 58, pivot about the rear knuckle joints 38 (i.e., in a clockwise direction when viewing the drawings) to a lowered position. In this position, the rear of the seat 10 is raised, as shown in FIGS. 3-4. Hooks 58 provide an element to anchor rear legs 42 at distal ends relative to a structural portion of the watercraft, such as frame, deck, or hull (not shown), in a fixed location on the watercraft. The hooks 58 may be supported in relation to a structural portion of the watercraft in any suitable manner. Elements for anchoring the rear legs 42 may take other forms, such as threaded fasteners or other movable or non-movable components. The hooks 58 are advantageous in that they enable expeditious removal of seats when that is desired.

Figure 6:
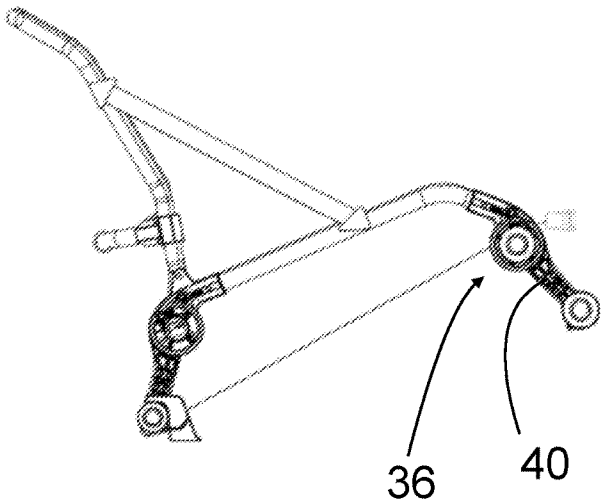
FIG. 6 is a side elevational view of the seat shown in FIG. 5.
Figure 5:
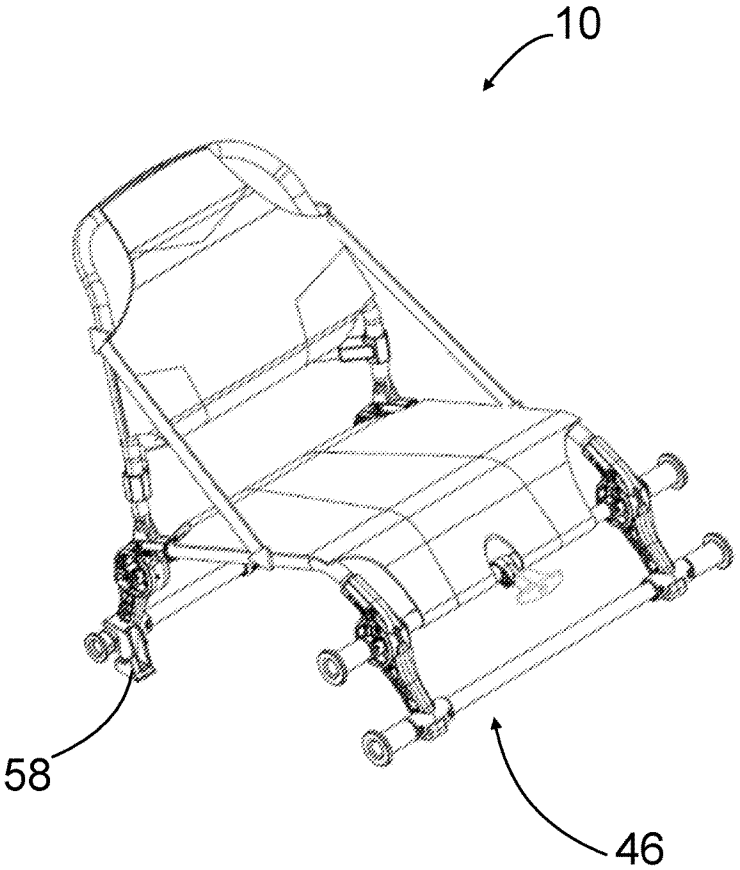
FIG. 5 is a front perspective view of the seat with the front end of the seat raised and front legs of the seat lowered.

To raise the front of the seat 10, the front leg cross bar 46 is moved in a forward direction (i.e., to the right when viewing the drawings), which in turn pivots the front legs 40 about the front knuckle joints 36 (i.e., in a counter-clockwise direction when viewing the drawings) to a lowered position, as shown in FIGS. 5-6.

Figure 8:
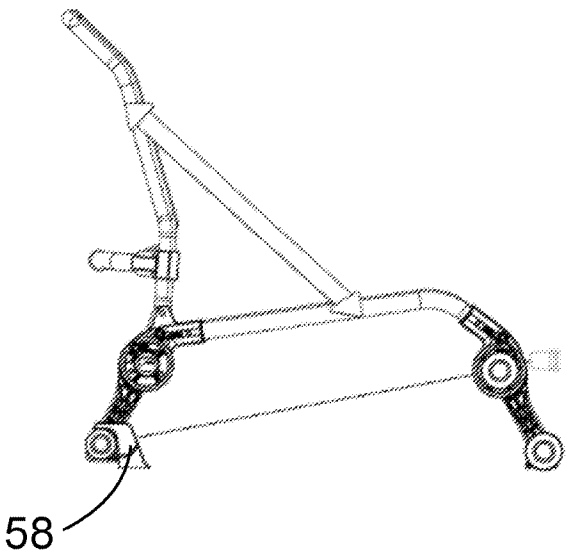
FIG. 8 is a side elevational view of the seat shown in FIG. 7.
Figure 7:
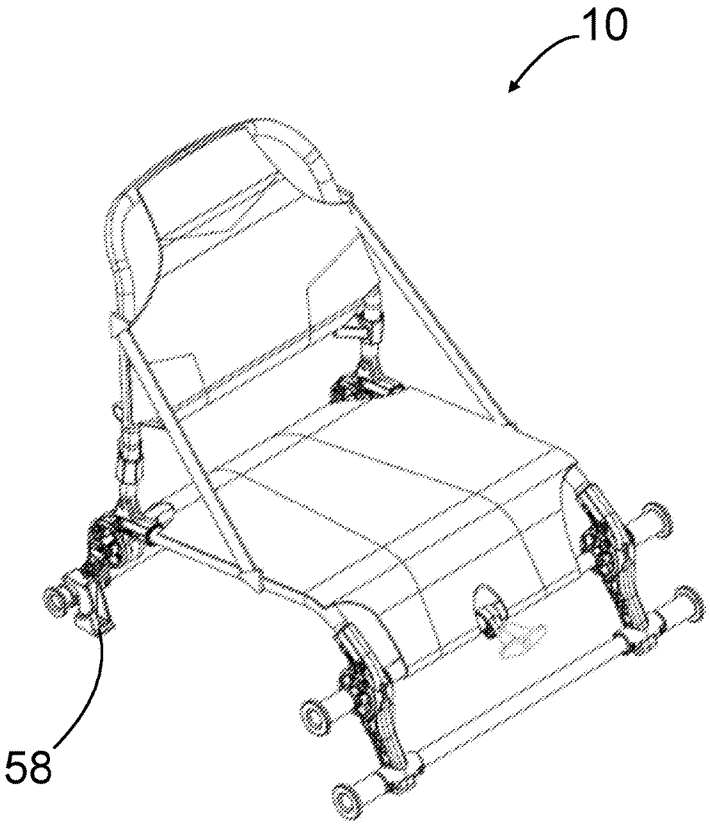
FIG. 7 is a front perspective view of the seat with the front end of the seat lowered so that the front and rear legs support the seat in a fully raised position.

With the front and rear legs 40, 42 lowered and resting on a supporting surface (i.e., a supporting surface of the watercraft), the seat 10 is in a raised position, as shown in FIGS. 7 and 8.

To lower the seat 10, the front of the seat 10 is lowered by moving the front leg cross bar 46 in a rearward direction (i.e., to the left when viewing the drawings), which in turn pivots the front legs 40 about the front knuckle joints 36 (i.e., in a clockwise direction when viewing the drawings) to a raised position, as shown in FIGS. 3-4. In this position, the front legs 40 are tucked substantially closely beneath the seat base side tubes 20.

To lower the rear legs 42, the pull handle 66 is pulled forward (i.e., to the right when viewing the drawings). This pulls the rear leg cross bar 50 in a forward direction (i.e., to the right when viewing the drawings) to a raised position, which in turn pivots the rear legs 42 about the rear knuckle joints 38 (i.e., in a counter-clockwise direction when viewing the drawings) to a raised position. In this position, the rear legs 42 are tucked substantially closely beneath the seat base side tubes 20. With the rear legs 42 in this position, the rear of the seat 10 is lowered, as shown in FIGS. 1-2. With the front and rear legs 40, 42 in the raised position, and the seat 10 lowered so that the front of the seat 10 are supported by the supporting surface, the seat 10 is in the lowered position, as shown in FIGS. 1-2.

For simplification, the pull cord 60 is pulled taut in each of the drawing views. However, it should be understood that the pull cord 60 would be slack when the rear legs 42 are raised, as shown in FIG. 2, and substantially taut when the rear legs 42 are lowered, as shown in FIGS. 4, 6 and 8. The pull cord 60 is preferably a flexible member and may be a flexible member such as a cable, strap, chain, or device other than a cord. However, it should be appreciated that the function of pull cord 60 may be provided by a lever or solid linkage arrangement, or a combination of flexible and solid components if desired.

Referring now to FIGS. 9-23, there is illustrated a seat retention mechanism 110 for watercraft (not shown). The mechanism 110 is particularly suitable for kayaks. The mechanism 110 generally comprises a first member 112 that is configured to be mounted to the watercraft and receives or otherwise cooperates with a seat component 116 (e.g., a graspable transverse cross bar such as a component part of or associated with the base tubes or cross bars 16, 18 shown in FIG. 1), and a second member 114 that is configured to operatively and releasably hold the seat component 116 in relation to the first member 112 for securely supporting a seat 10 (shown in FIGS. 22-23) in relation to the watercraft.

In accordance with the illustrated embodiment, the first member 112 comprises a mount 118 or attachment element, which can be formed as an integral component of the watercraft, or it can be a component retrofit for attachment to the watercraft. The mount 118 or attachment element can be attached to the watercraft in any suitable manner, such as by providing through holes 120 in the mount 118 for receiving threaded fasteners (not shown), which may be threaded into the hull of the watercraft. Alternatively, fasteners may be threaded through the hull from within the hull into an underside of the mount 118. As yet another alternative, the mount 118 be configured to comprise a structure suitable to interlock or otherwise cooperate with the hull or other surface of the watercraft for securely attaching the mount 118 to the watercraft. The mount 118 may also be formed as an integral part of the hull.

The illustrated mount 118 comprises a bottom member 122 and side walls 124, supported in spaced relation to one another, and in relation to the bottom member 122. The bottom member 122 and side walls 124 form a structure akin to a trough 126, defining an elongate channel 128 between the side walls 124 for receiving the second member 114, as will become apparent in the description that follows. In the illustrated embodiment, longitudinally disposed ends (shown but not referenced) of the mount 118 are open, however, the one or each of the ends may be enclosed or partially enclosed. Additionally, the mount 118 can be structured to provide suitable access to mounting holes, such as the through holes 120 described above, for receiving fasteners for attaching the mount 118 to the hull or another suitable surface of the watercraft. It should be understood that the mount 118 may be of a single-piece, unitary construction or formed of a plurality of component parts securely assembled in relation to one another in any suitable fashion.

The bottom member 122 and/or the side walls 124 cooperatively form a T-slot 134 (FIG. 21) for receiving or otherwise cooperating with a T-shaped structure 160 supported in relation to the second member 114. It should be appreciated that the mount 118 may alternatively be provided with a T-shaped structure and the second member 114 may be provided with a T-slot. It should further be appreciated that other structures may be suitable in the place of the T-slot and T-shaped structures shown. In the illustrated embodiment, a ridge, projection, protrusion, tab or other suitable extending structure 138 (FIG. 21) extends inwardly from or is otherwise supported inwardly in relation to an inner surface or area 140 (FIG. 21) of each of the side walls 124. The extending structure 138 of each side wall 124 faces the extending structure 138 of the other side wall 124 to form an opposingly disposed structure arranged in spaced relation to form a first elongated opening or space (shown but not referenced) therebetween. The extending structure 138 is at least partially defined by a wall or surface (shown but not referenced), which extends in a substantially vertical direction when viewing the drawings. Consequently, the surfaces of the two opposing extending structures 138 are arranged substantially parallel to one another, although a parallel arrangement is not necessary. Upper and lower surfaces (shown but not referenced) of each extending structure 138 are disposed in a substantially horizontal direction, so that the upper and lower surfaces are arranged substantially parallel to one another, although a parallel arrangement is not necessary.

Beneath the extending structure 138 is disposed a second elongate opening or space 148 (FIG. 21), which has a larger dimension in width, or which is wider in a lateral direction, than the first opening. This provides a shoulder (shown but not referenced) beneath the extending structure 138 for cooperating with a corresponding portion of the T-shaped structure 160 of the second member 114. The second elongate opening 148 is sufficiently dimensioned and configured to receive a portion of the T-shaped structure 160 of the second member 114 so that the T-shaped structure 160 is free to travel in relation to the T-slot 134.

In summary, the T-slot 134 and the T-shaped structure exemplify a guide feature for constraining the slide 154 against movement relative to the first member 112 except movement parallel to the longitudinal axis of the first member 112.

The inner surface 140 of each of the side walls 124 may be tapered downwardly, or towards a lower end or region thereof, so that the elongate channel 128 between the side walls 124 is a substantially V-shaped channel (i.e., in a lateral direction) that mates with cooperating surfaces of the second member 114 so as to center the second member 114 in the channel 128 and promote lateral stability of the second member 114 in relation to the first member 112. However, it should be understood that a taper is not necessary and that the inner surfaces may be parallel to one another or have some other suitable orientation.

The side walls 124 each has reliefs, cutouts, openings 152, or are otherwise suitably configured to receive a corresponding component or portion of a seat, such as a leg portion, or more particularly, a cross bar 116 of a seat, which is substantially horizontally disposed. In the illustrated embodiment, the openings 152 are substantially U-shaped openings, which are dimensioned and configured to receive a cross bar that is substantially cylindrical in shape, or other suitably shaped structure supported in relation to the seat. It should be appreciated that the cross bar 116 need not be cylindrical. In the illustrated embodiment, three openings 152 are provided. However, it should be appreciated that fewer, as few as one opening 152, or a greater number of openings 152 may be provided. The openings 152 of each side wall 124 are arranged to laterally align with corresponding openings 152 in the other side wall 124, so that the cross bar 116 or similarly shaped structure may extend through corresponding openings 152 in each side wall 124.

In general terms, the openings 152 face the seat 10 and are configured to receive therein a graspable member (e.g., the seat component, portion, leg portion, cross bar 116) of the seat 10, thereby receiving weight borne by the seat 10. The openings 152 constrain the seat 10 against longitudinal motion relative to the watercraft (not shown) and prevent the seat from tipping or flipping rearward.

Figure 16:
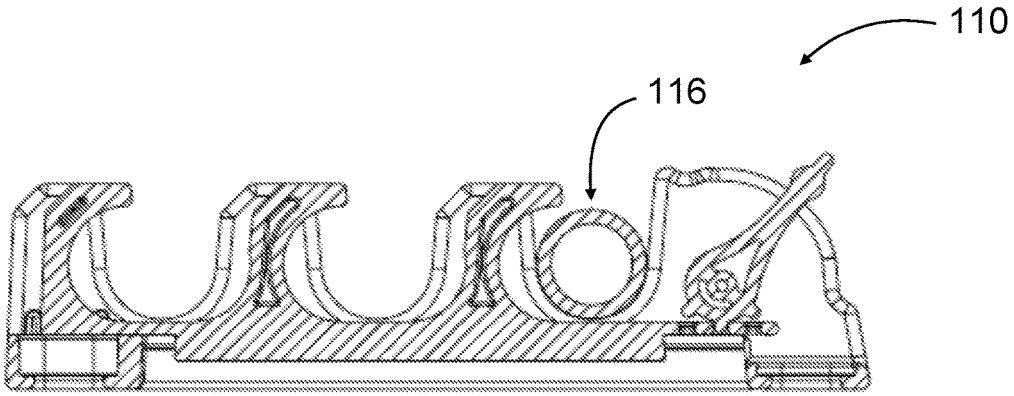
FIG. 16 is a sectional view of the seat retention mechanism and seat portion shown in FIG. 7, taken in a longitudinal direction.
Figure 17:
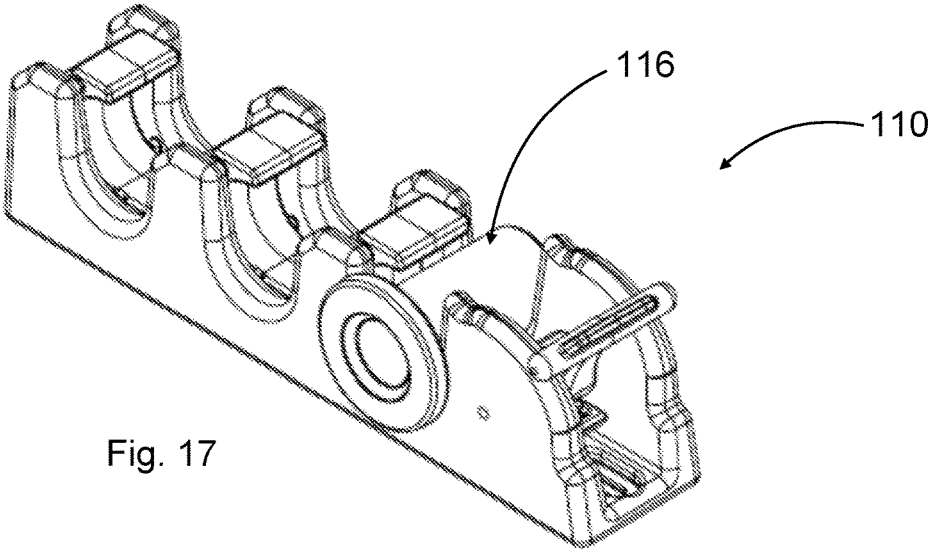
FIG. 17 is a perspective view of the seat retention mechanism and seat portion shown in FIG. 7.
Figure 18:
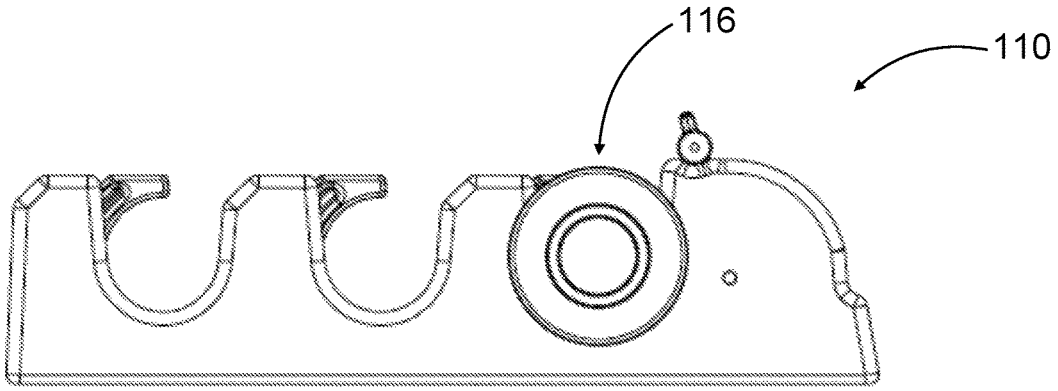
FIG. 18 is a side elevational view of an exemplary seat retention mechanism in a partially unlocked position, with a seat portion fully inserted into an opening thereof.
Figure 19:
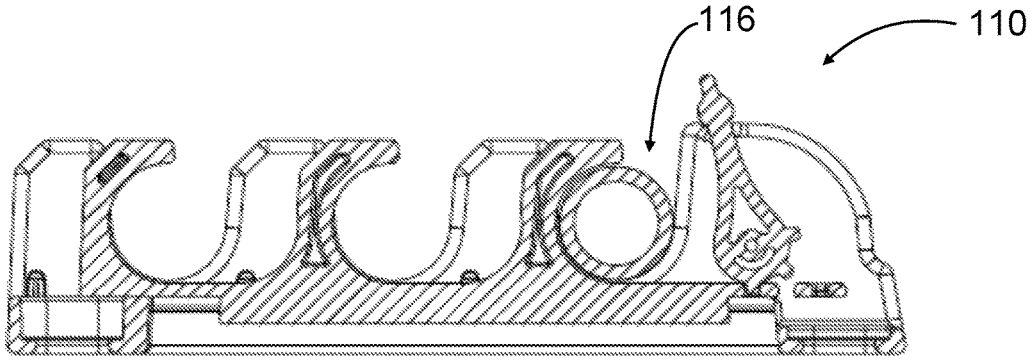
FIG. 19 is a sectional view of the seat retention mechanism and seat portion shown in FIG. 10, taken in a longitudinal direction.
Figure 20:
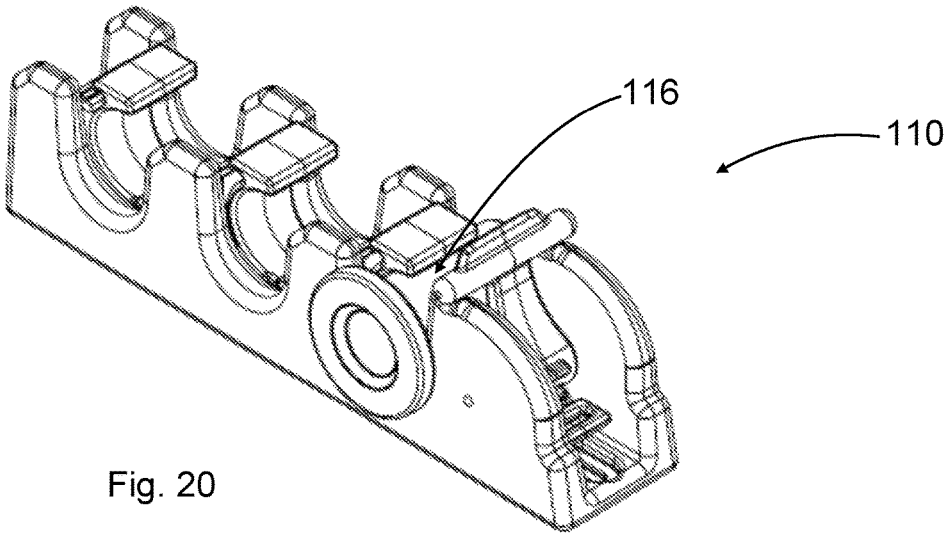
FIG. 20 is a perspective view of the seat retention mechanism and seat portion shown in FIG. 10.
Figure 21:
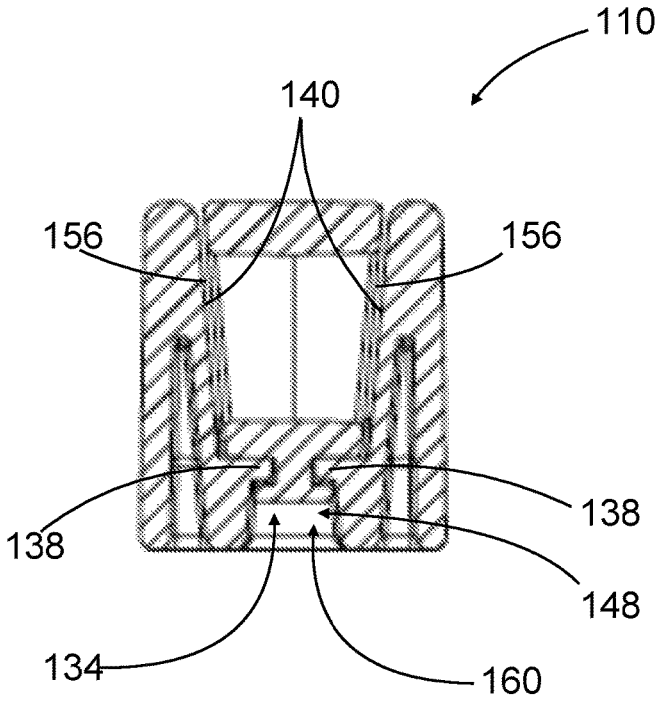
FIG. 21 is a sectional view of the seat retention mechanism taken in a lateral direction, to show a T-shaped structure and cooperation T-slot of a trough and cooperating slide.

Now, with reference to the second member 114, the second member 114 comprises a slide 154, carriage or the like, which is preferably dimensioned and configured to fit snuggly for linear longitudinal movement (i.e., in a longitudinal direction) in the channel 128 when moving between a locked position (e.g., as shown in FIG. 19) and the unlocked position (e.g., as shown in FIG. 16).

In the illustrated embodiment, the slide 154 has side walls 156, which are tapered downwardly, or towards a lower end or region thereof, so that the slide 154 is a substantially V-shape, so that the slide 154 mates with cooperating surfaces of the first member 112 so as to center the slide 154 in relation to the channel 128 and promote lateral stability of the slide 154 in relation to the channel 128, as described above. As stated above, a taper is not necessary. The side walls 156 of the slide 154 may be parallel to one another or have some other suitable orientation.

The slide 154, or a lower portion or bottom member thereof (shown but not referenced), has a headed (e.g., T-shaped) structure 160 supported thereby, or extending downwardly therefrom. The headed structure is entrapped by the extending structures 138 in close, slidable fit therewith. The T-shaped structure 160 cooperates with the T-slot 134 so the T-shaped structure 160 is received by or otherwise cooperates with a T-slot 134. It should be appreciated that the mount 118 may alternatively be provided with a T-slot and the slide 154 may be provided with a T-shaped structure. It should further be appreciated that other structures may be suitable in the place of the T-slot and T-shaped structures shown. The T-shaped structure 160 cooperates with the T-slot 134 so that the slide 154 is held in relation to the T-shaped structure 160 so that the slide 154 moves linearly in a longitudinal direction (i.e., left to right and right to left when viewing the drawings). Movement of the slide 154 will be described in more detail in the description that follows.

The slide 154 is slidably movable along the first member 112 between a locked position and an unlocked position. The slide 154 therefore includes an obstructive member (e.g., an overhanging structure 168, to be described hereinafter) for each opening 152. When the slide 154 is slid to the locked position, the obstructive member obstructs the openings 152 and prevents the graspable member (e.g., the seat component, portion, leg portion, cross bar 116) of the seat 10 from escaping from the first member 112.

The slide 154 is structured and dimensioned to define entrapment areas 162 for entrapping a corresponding portion of the seat 10, such as the horizontally disposed leg portion, or the cross bar 116, described above. In the illustrated embodiment, three entrapment areas are provided. These correspond in number to the U-shaped openings 152 of the trough 126, and may be fewer in number, as few as one, or greater in number, commensurate with the number of U-shaped openings 152. The entrapment areas 162 may be defined at least in part by a C-shaped structure 164. The C-shaped structure 164 defines a curved surface 166 that at least partially aligns with a corresponding curved surface that partially defines the U-shaped opening 152, when the slide 154 is in a locked position. The curved surface 166 is substantially semi-cylindrical in shape and dimensioned to closely conform to the corresponding portion of the seat 10 (e.g., the horizontally disposed leg portion, or the cross bar 116). The C-shaped structure 164 defines an overhanging structure 168, which when the slide 154 is in the locked position, traps the portion of the seat 10 therein, to retain the seat 10. That is to say, the overhanging structure 168 encloses at least a portion of the U-shaped opening 152 of the trough 126, to prevent the portion of the seat from escaping from the U-shaped opening 152. The openings 152 are oriented and configured to engage and receive the transverse graspable member (e.g., the seat component, portion, leg portion, cross bar 116) of the seat 10.

The slide 154 is operable to move between the locked position and an unlocked position. This can be done in any suitable manner. In the illustrated embodiment, and with particular reference to FIG. 10, this is accomplished by a rack and pinion structure 170. A fixed cog or toothed structure 172 may be supported in fixed relation to an end of the second member 114 or slide 154. A rotational cog 174 or gear may be supported for rotational movement in relation to a corresponding end of the first member 112 or trough 126. The rotational cog 174 meshes with the toothed structure 172 to move or advance and retract the slide 154 between the locked and unlocked positions.

The rotational cog 174 is supported in relation to the trough 126 by a pivot pin 176 that extends laterally between the two side walls 124 of the trough 126, and which is supported in relation to the side walls 124. This can be accomplished in any suitable manner, such as, for example, by providing holes 178 in the side walls 124 in which the pin 176 may be supported. The pin 176 may be inserted through a hole 178 in one of the side walls 124, through the rotational cog 174, and further into a corresponding hole 178 in the other side wall 124.

In the illustrated embodiment, a lever 179 controls the rotational cog 174. The lever 179 extends beyond an open end (shown but not referenced) of the trough 126. The lever 179 is a T-shaped lever 179, comprising a radially extending member 180 and laterally extending cross-member 182, which cooperates with the end of the trough 126 to hold the lever 179 in the locked or unlocked position, as will become more apparent in the description that follows. This can be accomplished in any suitable fashion. In the illustrated embodiment, the end of the trough 126 has an arcuate or curved surface 186, wherein the focal point of the curved surface 186 is substantially coincident with the pivot axis of the pivot pin 176 supporting the rotational cog 174. The radial extent or distance of the radially extending member 180 of the lever 179, between the pivot axis and the cross-member 182, and the radial distance between the curved surface 186 and the pivot axis are preferably substantially the same, so that the cross-member 182 travels along the curved surface 186 during operation of the lever 179. It should be understood that the lever 179 exemplifies a manual actuator operable to move the slide 154 between the locked position and the unlocked position.

A detent 190 or catch is provided at opposing or terminal ends (shown but not referenced) of the curved surface 186. The detents 190 are provided for cooperating with opposing ends (shown but not referenced) of the cross-member 182, so that the opposing ends of the cross-member 182 snap into the detents 190 to hold the lever 179 in the locked and unlocked positions.

Figure 9:
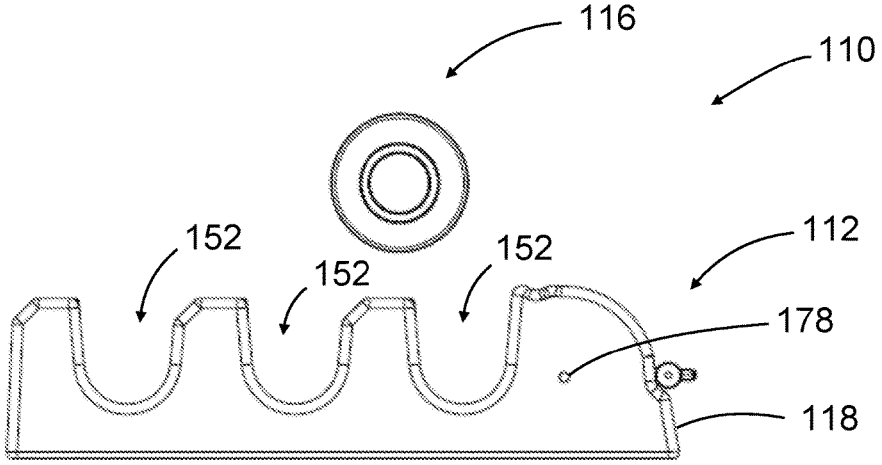
FIG. 9 is a side elevational view of an exemplary seat retention mechanism in an unlocked position, with a seat portion for insertion into an opening thereof.
Figure 10:
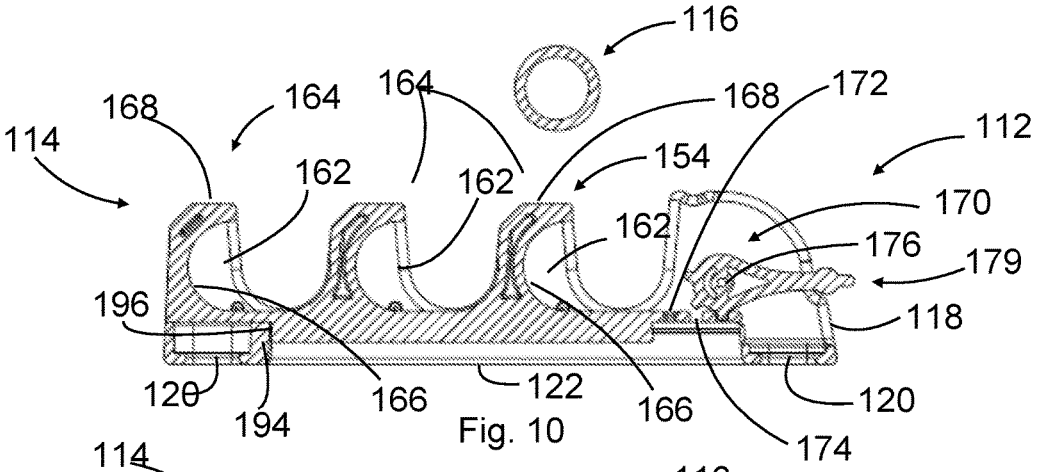
FIG. 10 is a sectional view of the seat retention mechanism and seat portion shown in FIG. 1, taken in a longitudinal direction.
Figure 11:
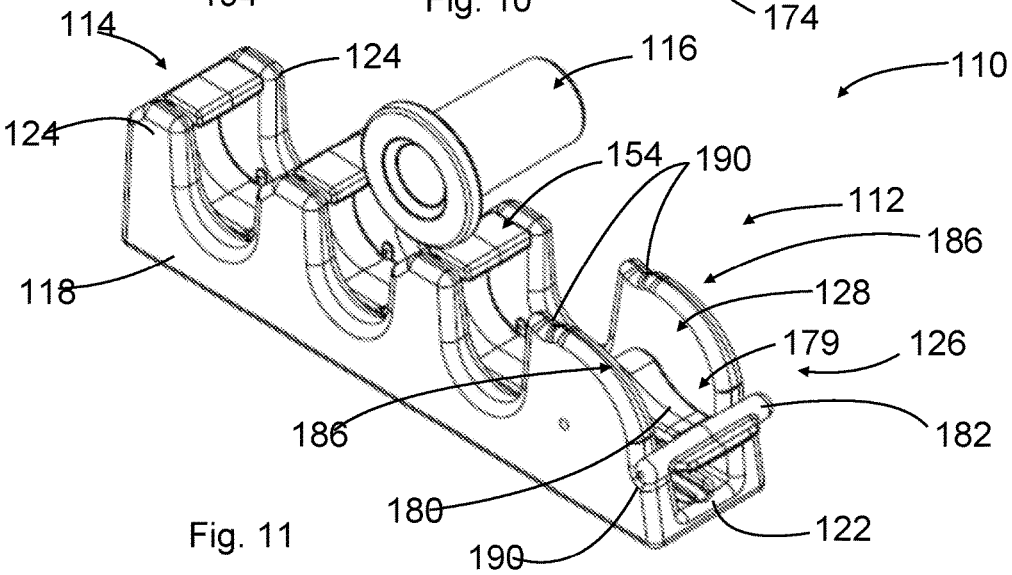
FIG. 11 is a perspective view of the seat retention mechanism and seat portion shown in FIG. 1.
Figure 12:
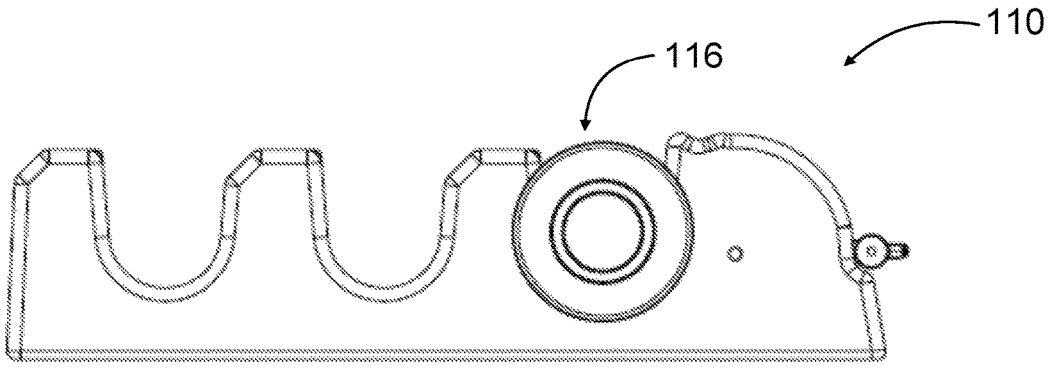
FIG. 12 is a side elevational view of an exemplary seat retention mechanism in an unlocked position, with a seat portion fully inserted into an opening thereof.
Figure 13:
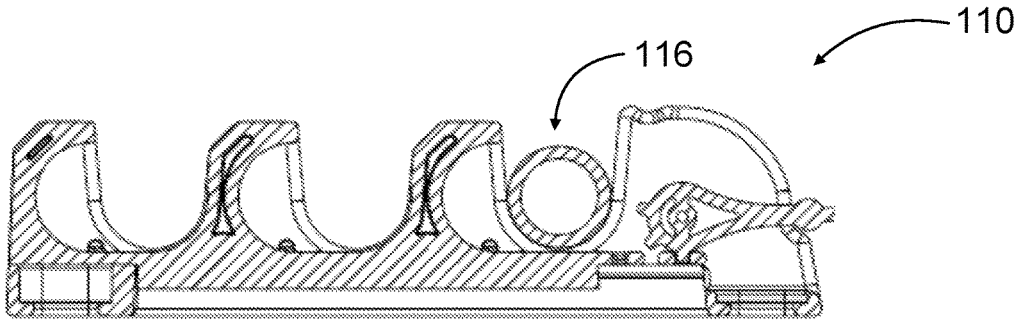
FIG. 13 is a sectional view of the seat retention mechanism and seat portion shown in FIG. 4, taken in a longitudinal direction.
Figure 14:
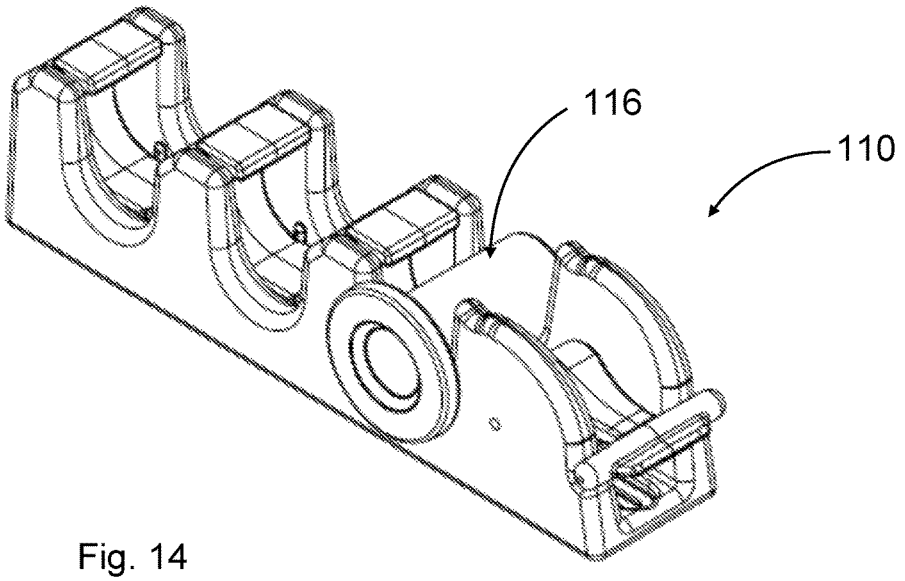
FIG. 14 is a perspective view of the seat retention mechanism and seat portion shown in FIG. 4.
Figure 15:
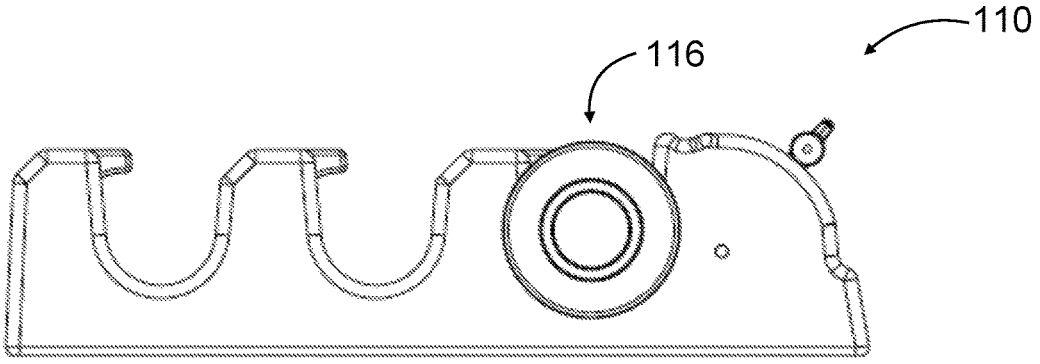
FIG. 15 is a side elevational view of an exemplary seat retention mechanism in a partially unlocked position, with a seat portion fully inserted into an opening thereof.

In operation, with the cross-member 182 engaging the lowermost detent 190, the lever 179 is held in the unlocked position, as is the retention mechanism 110, as shown in FIGS. 9-11. In this position, the seat component, portion, leg portion, cross bar 116 may be inserted into corresponding U-shaped openings 152, as shown in FIGS. 12-14. As the lever 179 is moved (i.e., in a counter-clockwise direction when viewing the drawings), the rotational cog 174 meshes with the toothed structure 172 to move the slide 154 to the locked position (i.e., to the right when viewing the drawings), as shown in FIGS. 15-20. With the cross-member 182 engaging the uppermost detent 190, the lever 179 is held in the locked position, as is the retention mechanism 110. When a force is sufficient to overcome the force holding the lever 179 in the detent 190, the lever 179 can be moved (i.e., in a clockwise direction when viewing the drawings), and the rotational cog 174 meshes with the toothed structure 172 to move the slide 154 to the unlocked position (i.e., to the left when viewing the drawings), as shown in FIGS. 12-14. With the cross-member 182 engaging the lowermost detent 190, the lever 179 is held in the unlocked position, as described above.

Figure 23:
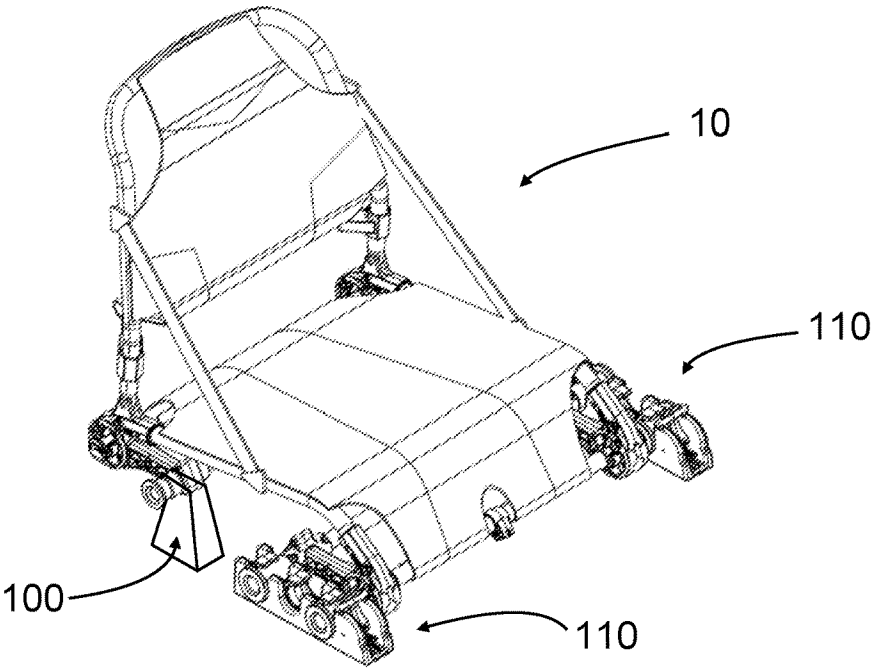
FIG. 23 is a front perspective view of the seat retention mechanism and the seat shown in FIG. 14.
Figure 22:
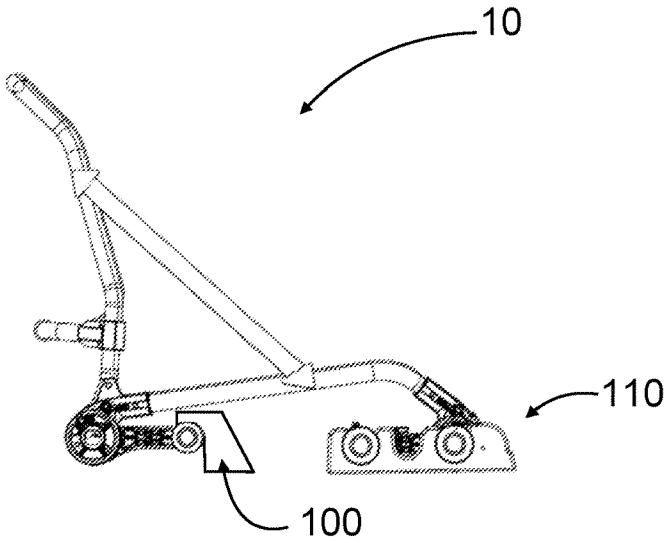
FIG. 22 is a side elevational view of the seat retention mechanism retaining front legs of a seat.

It should be appreciated that the actuator (e.g., the lever 179) is accessible to a seated occupant of the seat 10 from the front of the seat 10, as shown in FIG. 23.

The mechanism 110 comprises a stop 194, which is in the form of a raised structure, which cooperates with a shoulder 196 or other suitable structure on the slide 154 to limit the travel of the slide 154 in relation to the trough 126 (i.e., to the left when viewing the drawings). When the slide 154 engages the stop 194 (i.e., when the lever 179 is fully rotated in a clockwise direction), the overhanging structure 168 clears the U-shaped opening 152 to permit unencumbered insertion of the seat portion 116 in the U-shaped opening 152.

It should be clearly understood that retention mechanisms 110 are intended to be used, for example, in laterally spaced relation, on the watercraft to retain opposing legs (e.g., front legs or rear legs). In a preferred embodiment, rear legs of a seat 198 may be hooked in place by hooks 100 and front legs may be retained by the retention mechanism 110 described herein.

It should be appreciated that the seat 10 may be formed of any suitable material, including, for example, metal, plastic, or other suitable material. Various components thereof may be of solid construction or hollow, or a combination thereof. The same may be cast, cut, molded, extruded or formed in some other suitable manner.

While the seat and components parts thereof may have been described herein in terms of certain components being referred to in either the singular or the plural, other arrangements are possible. For example, it is to be understood that due to the conceptual description presented herein, components presented in the singular may be provided in the plural, and vice versa.

Similarly, it should be appreciated that the mechanism 110 may be formed of any suitable material, including, for example, metal, plastic, hard rubber or other suitable rigid material. The mechanism 110 and the various components thereof may be of solid construction or hollow, or a combination thereof. The same may be cast, cut, molded, extruded or formed in some other suitable manner.

While the mechanism 110 and components parts thereof may have been described herein in terms of certain components being referred to in either the singular or the plural, other arrangements are possible. For example, it is to be understood that due to the conceptual description presented herein, components presented in the singular may be provided in the plural, and vice versa.

While the mechanism 110 is described for use in retaining a seat 10, it should be understood that the mechanism 110 may be used as a general retaining mechanism, and not be limited to use as a seat retention mechanism.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A seat retention mechanism for securely supporting a seat in relation to a supporting surface, the seat comprising a graspable member, the seat retention mechanism comprising:

a first member for mounting to the supporting surface, the first member comprising:

an attachment element enabling the first member to be attached to the supporting surface, and at least one receiver configured to receive therein the graspable member of the seat to constrain the seat against longitudinal motion relative to the supporting surface;

a slide slidably movable along the first member between a locked position and an unlocked position, the slide including an obstructive member for the at least one receiver, the obstructive member being configured to obstruct the at least one receiver and prevent the graspable member of the seat from escaping from the first member when the slide is moved to the locked position; and an actuator operable to move the slide between the locked position and the unlocked position.

2. The seat retention mechanism of claim 1, wherein the at least one receiver is oriented and configured to engage and receive the graspable member of the seat in a transverse direction in relation to the seat retention mechanism.

3. The seat retention mechanism of claim 2, wherein the slide is configured to move linearly and in a longitudinal direction in relation to the support surface when moving between the locked position and the unlocked position.

4. The seat retention mechanism of claim 1, wherein the manual actuator comprises a pivotal lever having a toothed structure, and the slide mechanism comprises a cog or gear meshing with the toothed structure to move the slide upon pivoting the lever.

5. The seat retention mechanism of claim 1, further comprising a guide feature configured to limit movement of the slide relative to the first member in a direction parallel to the longitudinal axis of the first member.

6. The seat retention mechanism of claim 5, wherein the guide feature comprises opposed extending structures projecting from side walls of the first member, wherein the extending structures form an opposingly disposed structure arranged in spaced relation to form a first elongated opening or space therebetween, and the slide comprises a headed structure depending therefrom, the headed structure being entrapped by the extending structures in a close, slidable fit therewith.

7. The seat retention mechanism of claim 1, wherein the actuator is accessible to a seated occupant of the seat from the front of the seat.

8. A seat retention mechanism for securely supporting a seat in relation to a supporting surface of a watercraft, the seat comprising a front leg having a cross bar, the seat retention mechanism comprising:

a first member for mounting to the supporting surface, the first member comprising:

an attachment element enabling the first member to be attached to the supporting surface, and at least one receiver configured to receive therein the cross bar to constrain the seat against longitudinal motion relative to the supporting surface and prevent the seat from tipping or flipping rearward;

a slide slidably movable along the first member between a locked position and an unlocked position, the slide including an obstructive member for the at least one receiver, the obstructive member being configured to obstruct the at least one receiver and prevent the cross bar from escaping from the first member when the slide is moved to the locked position; and an actuator operable to move the slide between the locked position and the unlocked position.

9. The seat retention mechanism of claim 8, wherein the at least one receiver is oriented and configured to engage and receive the cross bar in a transverse direction in relation to the seat retention mechanism.

10. The seat retention mechanism of claim 9, wherein the slide is configured to move linearly and in a longitudinal direction in relation to the support surface when moving between the locked position and the unlocked position.

11. The seat retention mechanism of claim 8, wherein the manual actuator comprises a pivotal lever having a toothed structure, and the slide mechanism comprises a cog or gear meshing with the toothed structure to move the slide upon pivoting the lever.

12. The seat retention mechanism of claim 8, further comprising a guide feature configured to limit movement of the slide relative to the first member in a direction parallel to the longitudinal axis of the first member.

13. The seat retention mechanism of claim 12, wherein the guide feature comprises opposed extending structures projecting from side walls of the first member, wherein the extending structures form an opposingly disposed structure arranged in spaced relation to form a first elongated opening or space therebetween, and the slide comprises a headed structure depending therefrom, the headed structure being entrapped by the extending structures in a close, slidable fit therewith.

14. The seat retention mechanism of claim 8, wherein the actuator is accessible to a seated occupant of the seat from the front of the seat.

* * * * *